US005568954A

United States Patent [19]

Burgess

[11] Patent Number: 5,568,954

[45] Date of Patent: Oct. 29, 1996

[54] CEILING-MOUNTED DEVICE FOR STABILIZING A WORKPIECE

[76] Inventor: Robert K. Burgess, 621 Crystal Springs Rd., Lexington, S.C. 29072

[21] Appl. No.: 443,147

[22] Filed: May 17, 1995

[51] Int. Cl.[6] ..... E05C 17/44

[52] U.S. Cl. ..... 292/338; 292/DIG. 19; 118/500; 248/333; 248/343; 248/354.3; 248/354.5; 269/53; 269/905; 16/82

[58] Field of Search ..... 118/500, 502, 118/503; 248/333, 343, 354.3, 354.5, 354.6; 254/133 A; 269/53, 54.1, 69, 904, 905; 292/338, DIG. 19; 16/82, 115

[56] References Cited

U.S. PATENT DOCUMENTS

| | | | |
|---|---|---|---|
| 684,097 | 10/1901 | Quigley et al. | 118/500 |
| 855,219 | 5/1907 | Anthony, Jr. | 118/502 |
| 930,129 | 8/1909 | Beausejour et al. | 118/503 |
| 1,104,202 | 7/1914 | Lindahl | 248/333 |
| 1,725,424 | 8/1929 | Schimmel | 118/502 |
| 3,648,425 | 3/1972 | Bolton | 248/354.3 X |
| 3,737,134 | 6/1973 | Foon | 248/354.3 |
| 4,695,114 | 9/1987 | Stanton et al. | 439/573 |
| 4,757,975 | 7/1988 | Gordon et al. | 254/133 A |
| 4,988,067 | 6/1991 | Propp et al. | 248/343 |
| 5,090,648 | 2/1992 | Wood, IV | 248/125 |
| 5,164,011 | 11/1992 | Ray | 118/500 |
| 5,201,488 | 4/1993 | Hadbavny | 248/354.5 |

*Primary Examiner*—Jill Warden
*Assistant Examiner*—Harold Y. Pyon
*Attorney, Agent, or Firm*—Michael A. Mann, P.A.

[57] ABSTRACT

A device for holding a door upright for painting comprises a bracket that attaches the device to the electrical junction box in a ceiling, a telescoping rigid section held by the bracket, and a pin at the end of the rigid section that engages the top edge of the door. The telescoping rigid section adjusts to different door sizes and different ceiling heights. It also moves to a retracted position from an extended position, so that the door can be easily positioned and removed. In the vertical position, only slight force is needed to hold the door there, force provided in part by the attachment of the device to the junction box. Use of the junction box obviates the need for more elaborate support systems.

14 Claims, 1 Drawing Sheet

28
12
32
34
14
10
3
48
16
42
42
3
36
40

30
30a
14
12
30a
30
28

52
26
22
26
24
20
28
12
34
32
14
16

12
14
16
10
56
40
38

58
54

50
48
42
46

44
16
14

CEILING-MOUNTED DEVICE FOR STABILIZING A WORKPIECE

BACKGROUND OF THE INVENTION

1. Field of the Invention

The invention relates to a device for supporting a workpiece. In particular, the invention relates to a device for stabilizing a door while a door is being painted.

2. Discussion of Background

During the painting of an interior door of a building, it has been common practice to lean the door against a wall, possibly with a board interposed between the door and the wall. This method has many disadvantages, however. Paint tends to accumulate on the wall supporting the door, especially if the door is spray painted. Also, there is limited access to the door with this method, and the door has to be repositioned in order to paint both door sides. Further, comers of the door abutting the wall are difficult to paint.

Devices which have been developed for supporting workpieces to be painted are bulky and cumbersome. In U.S. Pat. No. 5,164,011, a device is described that includes a support base, a stand, and a spring-biased arm for supporting the door. The device must be disassembled for transportation and reassembled at the work site. Consisting of a plurality of large parts having different configurations, the device is not easily transported from one location to another.

Given the problems associated with a conventional approach to painting interior doors, and the shortcomings of presently available devices designed to overcome the problems of the conventional approach, there is a need for a device that can stabilize a workpiece being painted that is easily assembled and transported from one location to another, and which enables improved access to the to-be-painted workpiece.

SUMMARY OF THE INVENTION

According to its major aspects and broadly stated, the invention is a ceiling-mounted device for supporting a workpiece such as a door for painting. The device supports a door against a floor of a room by applying a downward vertical force to the top edge of the door while the bottom edge of the door rests on the floor of the room. The device is attached to the ceiling of the room, preferably to an electrical junction box carried by the ceiling.

In a preferred embodiment, the device comprises a rigid member having at one end means for mounting the member to a ceiling and at the opposite end, means for engaging the member with an edge of the door to be stabilized. The device may further include means for adjusting the length of the rigid member so that the device can have an extended position and a retracted position in order to stabilize different size doors from ceilings having different heights.

The device is preferably attached to an electrical lighting junction box of a ceiling. The device includes a bracket that has holes which align with threaded apertures of a junction box.

Extending downward from the bracket is a rod telescopingly received in a sleeve. Length of the rigid member may be adjusted by sliding the sleeve over the rod. The sleeve may be releasably secured to the rod by many alternative means. Most preferably, the rod has notches formed therein and the sleeve has a spring-biased peg matingly received by a notch of the rod.

Extending downward from the sleeve is a means for engaging the door. For doors made of relatively soft material, such as wood, the engagement means should be preferably a pin that can penetrate into the door edge.

In use, the mounting bracket of the device is attached to an exposed junction box of a ceiling. After the sleeve portion of the device is attached to the rod extending downward from the mounting bracket, a door, resting on the floor, is positioned under the device. The engaging end of the device is then contacted with the door and the door is stabilized. Only a slight downward force is required to stabilize the door.

A major feature of the invention is the mounting bracket which is adapted to be attached to an exposed junction box of a ceiling. Electrical lighting junction boxes are located in virtually every building and are typically found at the center of a room. The mounting bracket enables the device to utilize existing building structure in stabilizing a door. Since junction boxes are typically located at a center of a room, the mounting bracket adapted to be mounted to a junction box provides a stabilized door which can be accessed from all sides.

Another major feature of the invention is the rod-and-sleeve combination which provides a means for adjusting the length of the device. Because the device is adjustable, it can be used to stabilize many different sized workpieces and may be attached to ceilings of various heights. The invention's adjustment means also enables doors to be easily engaged for stabilization and disengaged when work is complete Still another feature of the invention is the pin at the end of the device which engages a door. The pin engages a door effectively, but contacts only a small portion of the door surface, thereby exposing for painting a maximum amount of a door surface.

Yet another feature of the invention is the securing means which releasably secures the sleeve of the device onto the rod in a certain position. The securing means ensures that a door will not become unstable once it is stabilized.

Other features and advantages will become apparent to those skilled in the art from a careful reading of the Detailed Description of Preferred Embodiment accompanied by the following drawings.

DETAILED DESCRIPTION OF PREFERRED EMBODIMENTS

Figure 1:
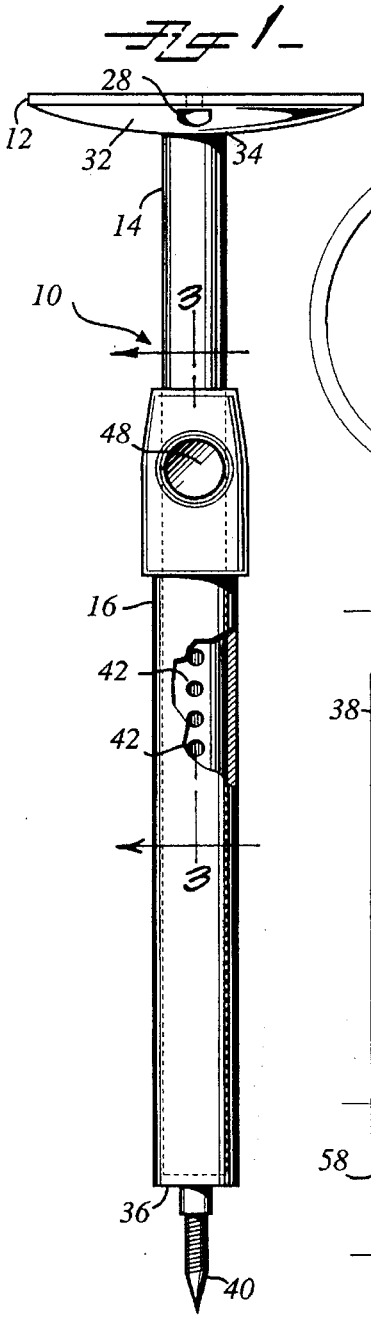
FIG. 1 is a side view of a device according to a preferred embodiment of the present invention having a cutaway portion showing the configuration of the device's rod.
Figure 2:
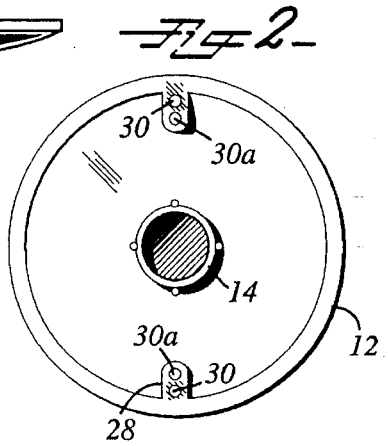
FIG. 2 is a top view of the mounting bracket of the device.
Figure 3:
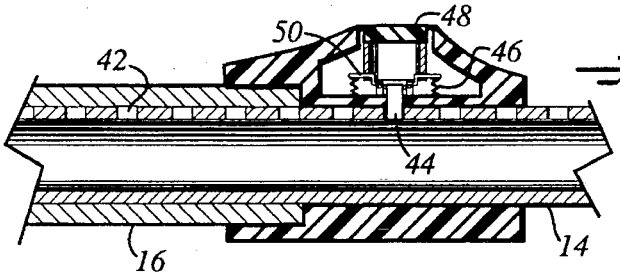
FIG. 3 is a cross-sectional view of the device taken along line 3—3 of FIG. 1, illustrating a preferred length adjusting and locking means.

FIGS. 1–3 show a preferred embodiment of the device 10 having a mounting bracket 12, a rod 14, a sleeve 16 and a door engaging means 40.

Figure 4:
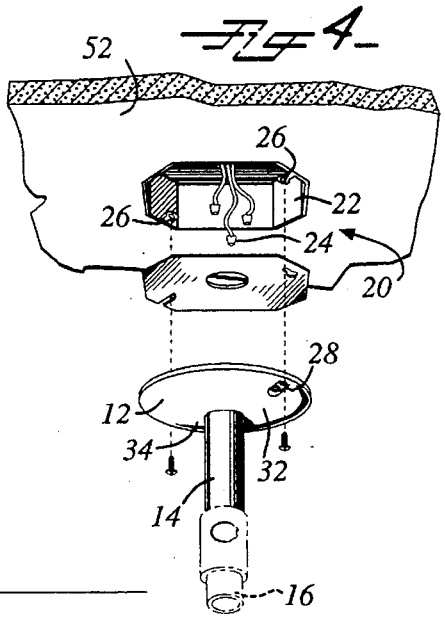
FIG. 4 is a perspective view of a standard junction box on which the mounting bracket may be mounted.

Mounting bracket 12 may be mounted anywhere on a ceiling but is adapted to and is preferably mounted on an electrical lighting junction box 20 that is exposed on a ceiling. Referring to FIG. 4, a junction box 20 typically includes a housing 22 that houses wires 24, and threaded apertures 26 for receiving screws of a light fixture (not shown). Mounting bracket 12 of the invention includes tabs 28 having holes 30 which are alignable with threaded apertures 26 of junction box 20. Mounting bracket 12 may have additional sets of holes, such as 30*a*, so that bracket 12 may be attached to different-sized junction boxes. Wires 24 of a junction box hang downwardly from junction box 20 when a light fixture is removed. Accordingly, mounting bracket 12 includes a cup portion 32 which receives the wires, so that tabs 28 of bracket 12 may be firmly abutted against junction box 20 when bracket 12 is attached to junction box 20.

Extending downward from bracket bottom 34 is rod 14. Rod 14 is preferably welded or otherwise formed to rigidly extend from bracket 12.

Rod 14 is adapted to receive sleeve 16 which slides over rod 14 and which may be adjusted to various positions on rod 14, so that the net length of the rigid member formed by the combination of rod 14 and sleeve 16 may be adjusted.

Formed at sleeve end 36 is an engaging means for engaging a door edge. When door 38 is made of wood or another relatively soft material, engaging means comprises a pin 40 having a sharp end that can penetrate into the surface of door 38 as shown in FIG. 1. If door 38 is made of a hard material, then pin 40 may be replaced with an engaging means comprising a friction-producing material such as rubber or a material coated with an adhesive. If door 38 is made of steel, then pin 40 may be replaced with a magnet.

While the preferred embodiment of device 10 is shown to have a rod 14 and a sleeve 16, it is understood that device 10 may be formed of a single rigid member of a length approximately equal to the length of the gap between a door edge and a ceiling.

If device 10 includes a telescoping rod and stem, rod and stem are preferably formed so that the position of sleeve 16 in relation to rod 14 can be secured. While rod 14 and sleeve 16 can be formed so that the friction force between rod and stem secures the relative position between the members, additional securing means may be provided to ensure that the position of sleeve 16 in relation to rod 14 remains stable.

FIG. 3 illustrates a preferred means for securing the position of sleeve 16 in relation to rod 14. As shown by the cutaway portion of FIG. 1, rod 14 may have a plurality of notches 42 formed along its length. These notches are formed to receive a peg 44 disposed on sleeve 16. As FIG. 3 illustrates, peg 44 is normally biased by spring 46 to engage with a notch 42 of rod 14. When peg 44 is engaged with a notch 42, sleeve 16 is secured to rod 14 and will not easily slip. For adjusting the length of device 10, button 48 is pressed to depress springs 46, and levers 50 lift peg 44 from notch 42. Sleeve 16 may then be moved to another position, and when button 48 is released, springs 46 bias peg 44 into another notch.

Of course, as will be recognized by those skilled in the art, a virtually endless number of different means may be employed to secure the position of sleeve 16 in relation to rod 14. For example, notches of rod 14 may be deleted, and spring-biased peg 44 of sleeve 16 may be replaced with a set screw which is tightened for securing sleeve 16 to rod 14 and loosened when the length of device 10 is adjusted. Alternatively, threads may be formed on rod 14 and sleeve 16 such that sleeve 16 is threadably received on rod 14. With such a system, the length of device 10 is adjusted simply by threading sleeve 16 onto rod 14 to a desired distance.

It will also be recognized that the orientation of rod 14 in relation to sleeve 16 is not critical. That is, a device may be provided having a female sleeve extending downwardly from mounting bracket 12, which receives a male rod having at its bottom end a door engaging means. Further, device 10 may have more than the two telescoping portions that are illustrated. By providing additional telescoping portions, the length of device 10 during transport can be minimized.

Figure 5:
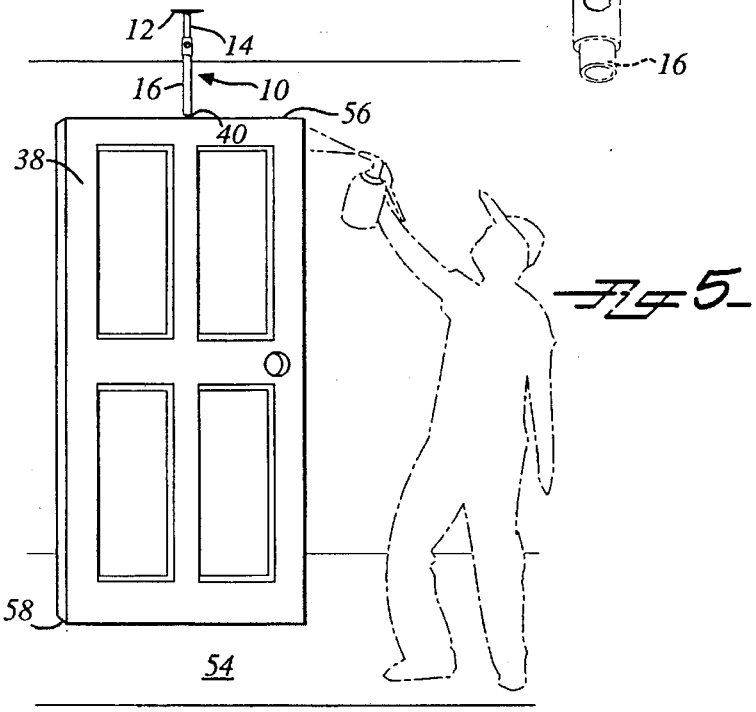
FIG. 5 is a view of the device in use, mounted to a ceiling and stabilizing a detached door.

Referring now to FIG. 5, use of the device will be described. In finishing the interior of a building, it is common practice to paint interior doors before light fixtures are installed. Thus, at the time doors are painted, junction boxes such as 20 will be exposed, and mounting bracket 12 may be installed thereon. Of course, if doors of a building are to be re-painted, an existing light fixture may be removed to expose a junction box. Because junction boxes are typically located in the center of a room, a door stabilized under a junction box will be accessible from all sides. In a painting project, several doors can be painted, one after another, using a single device 10, or several devices can be installed in several rooms of the building, and more than one door at a time can be painted.

It will be recognized that mounting bracket 12 need not be installed on junction box 20 but rather may be mounted anywhere on the ceiling of a building or on any apparatus or structure having a stable member of an elevation greater than that of a door to be worked on. For instance, mounting bracket 12 may be installed directly onto ceiling rafters through the drywall or plaster coveting such rafters. However, such a method would normally not be preferred, because the method would require repair of the ceiling after device 10 is removed.

Once mounting bracket 12 is installed onto ceiling 52, sleeve 16 is fitted onto rod 14 which rigidly extends downward from mounting bracket 12. When sleeve 16 is fitted onto a rod 14 in accordance with the embodiment of FIG. 3, the installer depresses button 48 of sleeve 16 so that peg 44 does not interfere with rod 14. Sleeve 16 is slid over rod 14 to a distance such that the distance between the engaging means 40 and floor 54 is slightly greater that the height of door 38. When such a distance is achieved, the installer releases button 48 to temporarily fix the position of sleeve 16 on rod 14.

At this time, door 38 is moved into a position such that top edge 56 of door 38 is directly under the device's door engaging means 40. Preferably a drop cloth or an appropriate substitute therefor is first fitted between door bottom 58 and floor 54. When door 38 is in a proper position under engaging means, button 48 is depressed and sleeve 16 is moved downward until engaging means 40 engages door 38. Usually this means that pin 40 extending downward from sleeve penetrates slightly into the wood forming door edge. Once the engaging means engages the door, the door is stabilized and in condition to be worked on.

It will be clear to those skilled in the art to which the present invention pertains from a reading of the foregoing that many changes and substitutions can be made to the preferred embodiments without departing from the spirit and scope of the present invention, which is defined by the appended claims.

What is claimed is:

1. A method for use in stabilizing a door in a room having a ceiling and a floor, said door having a top edge and an opposing bottom edge, said method comprising the steps of:

attaching a telescoping support to a ceiling, said support telescoping between a retracted position and an extended position;

positioning said door under said support, said bottom edge of said door against said floor;

extending said support to engage said top edge of said door whereby said door is stabilized against said floor by said support; wherein said ceiling carries an electrical junction box, and said attaching step further comprises the step of attaching said support to said electrical junction box; and said support having a first end and an opposing second end, said first end being attachable to said ceiling and said second end carrying a pin, and said engaging step further comprising the step of pushing said pin into said top edge of said door.

2. A device for use in stabilizing a door in a room having a ceiling and a floor, said door having a top edge and an opposing bottom edge, said device comprising:

a rigid member having a first end and a second end;

means carried by said first end for attaching said device to said ceiling of said room; and means carried by said second end for engaging said top edge of said door, so that said device stabilizes said door when said bottom edge of said door rests on said floor and said engaging means engages said top edge of said door; wherein said ceiling has a junction box, and said attaching means of said device is adapted to attach said device to said junction box; and wherein said attaching means is a bracket that is attachable to a junction box in said ceiling.

3. The device of claim 2, wherein said engaging means comprises a pin to penetrate said top edge of said door.

4. The device of claim 2, wherein said attaching means further comprises a bracket having at least one hole therethrough and at least one screw being insertable through said hole for adaptively attaching said bracket to said ceiling.

5. The device of claim 2, wherein said rigid member further comprises a plurality of telescoping member sections, one of said sections being attached to said attaching means and another of said sections being attached to said engaging means.

6. The device of claim 2, wherein said rigid member further comprises two telescoping member sections, one of said sections being attached to said attaching means and another of said sections being attached to said engaging means.

7. The device of claim 2, wherein said rigid member further comprises:

a rod attached to said attaching means; and a sleeve telescopingly received on said rod, said sleeve being slidable on said rod.

8. The device of claim 2, wherein said rigid member further comprises:

a rod attached to said attaching means;

a sleeve slidably received on said rod, said sleeve being slidable to various positions on said rod; and means for securing said sleeve to said rod.

9. The device of claim 2, wherein said rigid member further comprises:

a sleeve attached to said attaching means;

a rod slidably received in said sleeve, said rod being slidable to various positions in said sleeve; and means for securing said sleeve to said rod.

10. The device of claim 2, wherein said device has an extended position and a retracted position, said device holding said door when in said extended position, said device further comprising means for securing said device in said retracted position.

11. A device for use in stabilizing a door in a room having a ceiling and a floor, said door having a top edge and an opposing bottom edge, said device comprising:

a mounting bracket;

a telescoping member having a first section and a second section, said first section being attached to said mounting bracket, said telescoping member having an extended position and a retracted position; and means carried by said second section for engaging said top edge of said door, so that said device stabilizes said door when said bottom edge of said door rests on said floor and said engaging means engages said top edge of said door; wherein said ceiling carries an electrical junction box, and said mounting bracket is formed to be attached to said electrical junction box; and wherein said ceiling carries an electrical junction box, and said mounting bracket is formed to be attached to said electrical junction box, and said engaging means is a pin for penetrating said top edge of said door.

12. The device of claim 11, wherein said engaging means is a pin for penetrating said top edge of said door.

13. The device of claim 11, further comprising means for securing said device in said retracted position.

14. The device of claim 11, wherein said ceiling carries an electrical junction box, and said mounting bracket is formed to be attached to said electrical junction box, said device further comprising means for securing said device in said retracted position.

* * * * *